US006111507A

United States Patent [19]

Alicot et al.

[11] Patent Number: 6,111,507

[45] Date of Patent: Aug. 29, 2000

[54] ENERGIZING CIRCUIT FOR EAS MARKER DEACTIVATION DEVICE

[75] Inventors: Jorge Fernando Alicot, Davie; Douglas A. Narlow, Coral Springs; Richard L. Copeland, Boca Raton, all of Fla.; David N. Lambeth, Pittsburgh, Pa.

[73] Assignee: Sensormatic Electronics Corporation, Boca Raton, Fla.

[21] Appl. No.: 09/110,508

[22] Filed: Jul. 6, 1998

Related U.S. Application Data

[63] Continuation-in-part of application No. 09/016,175, Jan. 30, 1998, Pat. No. 6,060,988, which is a continuation-in-part of application No. 08/794,012, Feb. 3, 1997, Pat. No. 5,867, 101.

[51] Int. Cl.[7] ..... G08B 13/14

[52] U.S. Cl. ..... 340/572.1; 340/572.3; 340/572.4; 340/572.5; 340/551; 340/556

[58] Field of Search ..... 340/572.1, 572.3, 340/572.4, 572.5, 551, 555, 556

[56] References Cited

U.S. PATENT DOCUMENTS

| | | | |
|---|---|---|---|
| 4,728,938 | 3/1988 | Kaltner | 340/572.3 |
| 5,027,106 | 6/1991 | Uzzi et al. | 340/572.3 |
| 5,103,210 | 4/1992 | Rode et al. | 340/572.3 |
| 5,111,186 | 5/1992 | Narlow et al. | 340/572.5 |
| 5,142,292 | 8/1992 | Chang | 343/742 |
| 5,210,524 | 5/1993 | Schwarz et al. | 340/551 |
| 5,243,182 | 9/1993 | Murata et al. | 340/556 |
| 5,341,125 | 8/1994 | Plonsky et al. | 340/572 |
| 5,353,011 | 10/1994 | Wheeler et al. | 340/572.4 |
| 5,416,316 | 5/1995 | Kappeler | 340/556 |
| 5,469,142 | 11/1995 | Bergman et al. | 340/572 |
| 5,493,275 | 2/1996 | Easter | 340/572 |

*Primary Examiner*—Jeffery A. Hofsass
*Assistant Examiner*—John Tweel, Jr.
*Attorney, Agent, or Firm*—Robin, Blecker & Daley

[57] ABSTRACT

A device for deactivating a magnetomechanical EAS marker includes two coils and an energizing circuit for alternately driving the coils. One coil is driven for one cycle of an alternating power signal, and then the other coil is driven for one cycle, and this sequence is repeated. The driving signal is switched from one coil to the other at a point in time which corresponds to a zero crossing of the current level of the driving signal.

46 Claims, 9 Drawing Sheets

FREQUENCY DOUBLING CIRCUIT

ENERGIZING CIRCUIT FOR EAS MARKER DEACTIVATION DEVICE

CROSS-REFERENCE TO RELATED APPLICATION

This application is a continuation-in-part of prior application Ser. No. 09/016,175, filed Jan. 30, 1998, now U.S. Pat. No. 6,060,988, which has a common inventor with the present application and is a continuation-in-part of Ser. No. 08/794,012, filed Feb. 3, 1997 now U.S. Pat. No. 5,867,601.

FIELD OF THE INVENTION

This invention relates generally to electronic article surveillance (EAS) and pertains more particularly to so-called "deactivators" for rendering EAS markers inactive.

BACKGROUND OF THE INVENTION

It has been customary in the electronic article surveillance industry to apply EAS markers to articles of merchandise. Detection equipment is positioned at store exits to detect attempts to remove active markers from the store premises, and to generate an alarm in such cases. When a customer presents an article for payment at a checkout counter, a checkout clerk either removes the marker from the article, or deactivates the marker by using a deactivation device provided to deactivate the marker.

Known deactivation devices include one or more coils that are energizable to generate a magnetic field of sufficient amplitude to render the marker inactive. One well known type of marker (disclosed in U.S. Pat. No. 4,510,489) is known as a "magnetomechanical" marker. Magnetomechanical markers include an active element and a bias element. When the bias element is magnetized in a certain manner, the resulting bias magnetic field applied to the active element causes the active element to be mechanically resonant at a predetermined frequency upon exposure to an interrogation signal which alternates at the predetermined frequency. The detection equipment used with this type of marker generates the interrogation signal and then detects the resonance of the marker induced by the interrogation signal. According to one known technique for deactivating magnetomechanical markers, the bias element is degaussed by exposing the bias element to an alternating magnetic field that has an initial magnitude that is greater than the coercivity of the bias element, and then decays to zero. After the bias element is degaussed, the marker's resonant frequency is substantially shifted from the predetermined interrogation signal frequency, and the marker's response to the interrogation signal is at too low an amplitude for detection by the detecting apparatus.

One challenge faced in designing marker deactivation devices is the need to provide reliable deactivation of a marker regardless of the orientation of the marker at the time that the marker is presented for deactivation. Co-pending patent application Ser. No. 09/016,175, filed Jan. 30, 1998 discloses deactivation devices in which two or more coils are wound around magnetic cores. The devices are rapidly switched between two modes of operation, including a first mode in which one of the coils is driven with an alternating excitation signal and the second coil is not driven, and a second mode in which the second coil is driven with the excitation signal and the first coil is not driven. The first and second coils are disposed with orientations that are mutually orthogonal, so that, considering both modes, a marker presented to the deactivation device experiences a substantial alternating field regardless of the orientation of the marker. In practice, the marker is swept past the deactivation device and therefore is exposed to the decaying alternating field required to degauss the bias element of the marker.

The above-referenced '175 patent application has a common assignee and a common inventor with the present application. The disclosure of the '175 application is incorporated herein by reference.

In designing the deactivation device having core-wound coils as disclosed in the '175 application, it was desirable to provide an energizing circuit to provide the rapid switching between the two modes of operation described above, while also operating efficiently. A significant element of efficient operation is high throughput; that is, the deactivation device should be able to deactivate a number of markers in rapid succession. A limiting factor in terms of throughput is the maximum speed at which markers can be swept over the deactivation device while still providing reliable deactivation. It is desirable that a deactivation device perform reliably even when a marker is swept quite rapidly over the device.

Another problem encountered in prior art marker deactivation devices relates to a detection circuit included in the deactivation device to detect the marker and then trigger generation of the deactivation signal field. If a marker presented for deactivation has a marker signal frequency that deviates from the nominal marker signal frequency, the detection circuit may fail to detect the marker, so that operation of the deactivation device is not triggered, and deactivation does not occur. As a result, the marker may be detected by detection equipment at a store exit, thereby causing a false alarm.

Even when the marker signal is at the nominal frequency, the timing of the detection circuit is critical. If detection takes too long or if triggering is delayed, or if the marker is simply swept too rapidly, the deactivation signal field may be generated after the marker has passed through the region in which the deactivation field is radiated. Again, the outcome in such a case is a failure to deactivate the marker, and a potential false alarm at the store exit.

OBJECTS AND SUMMARY OF THE INVENTION

It is a primary object of the present invention to provide an efficient energizing circuit for a multiple-mode EAS marker deactivation device.

It is a further object of the invention to provide an energizing circuit which makes the deactivation device easy to use.

It is still another object of the invention to provide an EAS marker deactivation device which operates reliably and with high throughput.

According to an aspect of the invention, there is provided an apparatus for deactivating a magnetomechanical EAS marker, including a first coil, a second coil, and a circuit for energizing the first and second coils with an alternating drive signal to generate respective alternating magnetic fields for deactivating the marker, the circuit including switching circuitry for switching the apparatus between a first mode of operation in which the first coil is energized and the second coil is not energized, and a second mode of operation in which the second coil is energized and the first coil is not energized, with the switching circuitry operating to switch the apparatus between the modes of operation at times corresponding to zero-crossing points of the alternating magnetic fields. Preferably, the first mode is carried out in a first sequence of time intervals and the second mode is carried out in a second sequence of time intervals interleaved with the first sequence of time intervals, and with each of the time intervals having a duration that is no longer than one cycle of the alternating drive signal. It is further preferred that the energizing circuit include a first capacitor connected in series with the first coil and maintained in a charged condition during the second mode of operation, as well as a second capacitor connected in series with the second coil and maintained in a charged condition in the first mode of operation. Alternatively, the circuitry may include a source of an alternating drive signal and a capacitor connected in series with the drive signal source, and the circuit may operate to switch the capacitor between a series connection with the first coil and a series connection with the second coil. (It is to be understood that the term "alternating drive signal", as used herein and in the appended claims, refers to an alternating signal present in a coil or coils used to generate an alternating magnetic field applied to a magnetomechanical EAS marker to deactivate the marker.)

According to a further aspect of the invention, there is provided an apparatus for deactivating a magnetomechanical EAS marker including at least one coil, a trigger circuit which includes at least one optical sensor, and another circuit responsive to the trigger circuit for selectively energizing the at least one coil, where the trigger circuit includes circuitry for comparing with a threshold a signal level output by the at least one optical sensor, and circuitry for adjusting the threshold in accordance with fluctuations in the signal level output by the at least one optical sensor.

Deactivation devices provided in accordance with the invention operate efficiently both in terms of power consumption and convenience of use. A substantially uniform deactivation field is provided for all possible orientations of the EAS marker by switching between operating modes, and the mode-switching is carried out in a manner which conserves operating power and maximizes throughput at the checkout counter.

The foregoing, and other objects, features and advantages of the invention will be further understood from the following detailed description of preferred embodiments and from the drawings, wherein like reference numerals identify like components and parts throughout.

DESCRIPTION OF PREFERRED EMBODIMENTS

A preferred embodiment of the invention will now be described, initially with reference to FIGS. 1–3.

Figure 1:
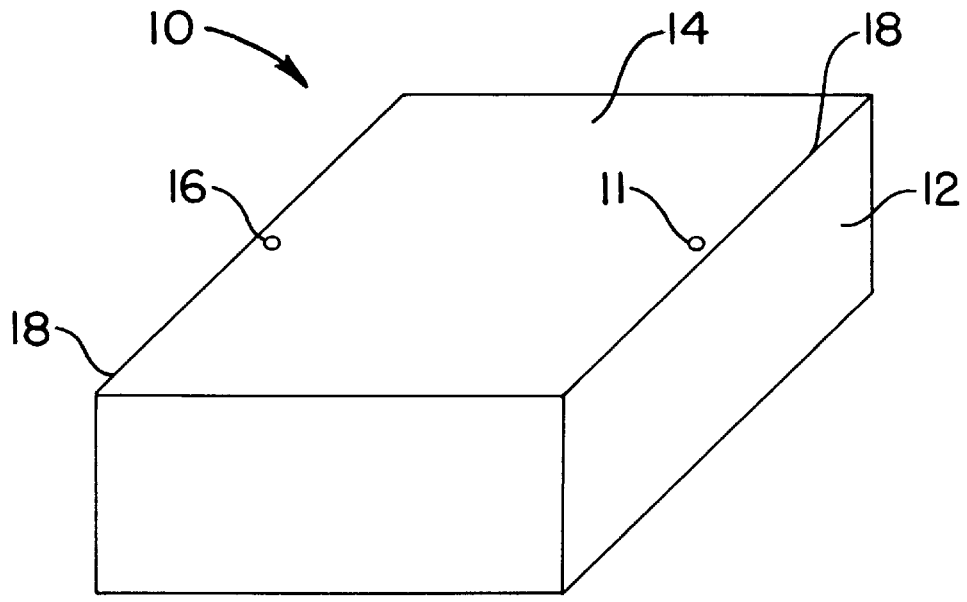
FIG. 1 is a somewhat schematic isometric view of the exterior of a marker deactivation device provided in accordance with the invention.

FIG. 1 shows the exterior of a deactivation device 10 provided in accordance with the invention. The device 10 includes a housing 12, which may be formed of molded plastic. The housing 12 has a substantially square top surface 14 over which EAS markers (not shown) may be swept for deactivation. Installed on the top surface 14 are optical sensors 16. As shown in FIG. 1, the number of optical sensors is two, and each sensor is installed adjacent to a central portion of a respective one of a pair of opposed edges 18 of the top surface 14.

The housing 12 contains electrical components of the deactivation device 10, as will be described below. As will be seen, the optical sensors 16 are provided to trigger operation of the deactivation device 10.

Figure 2:
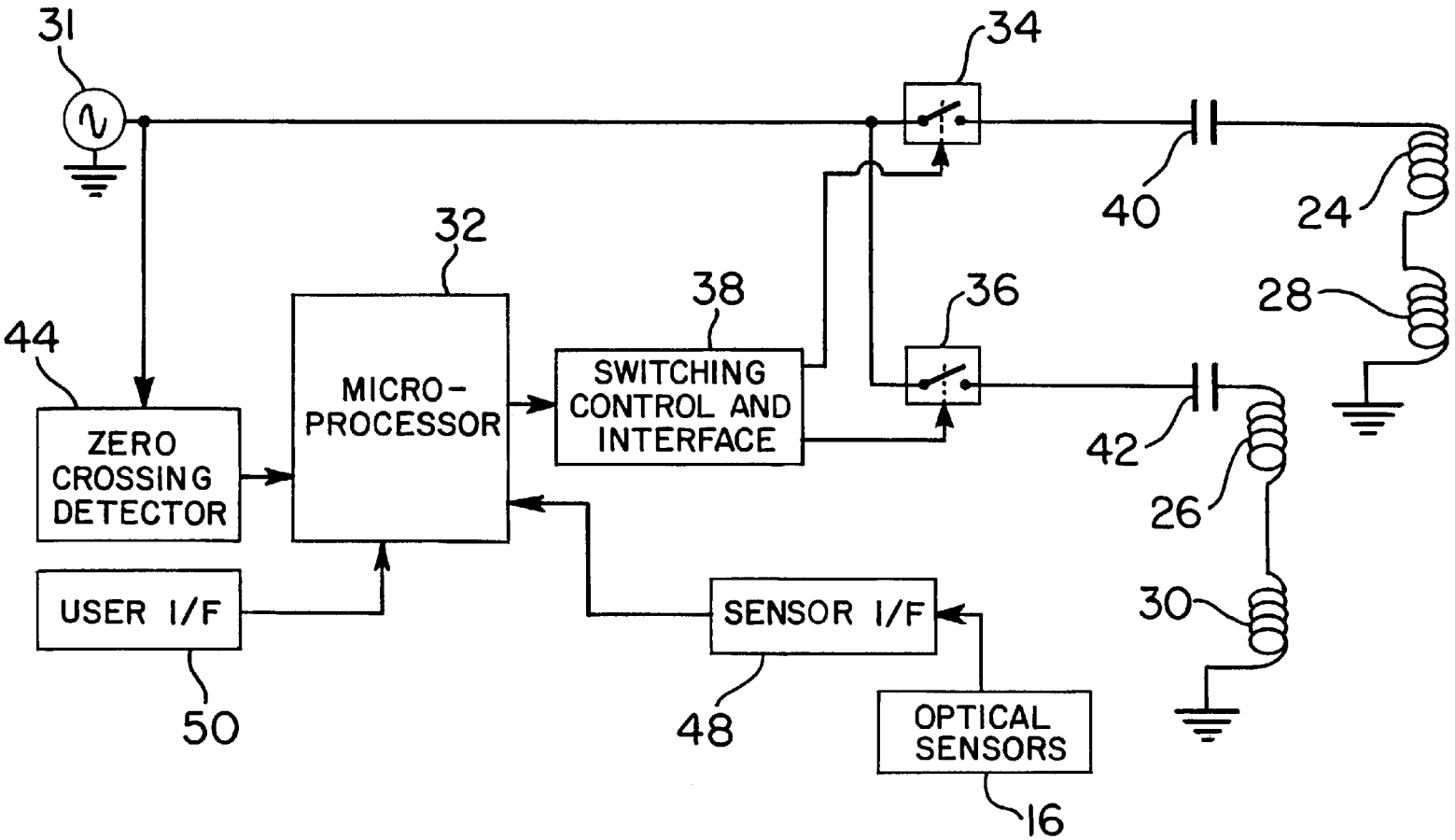
FIG. 2 is a block diagram representation of electrical components of the deactivation device of FIG. 1.

FIG. 2 shows, in the form of a block diagram, the electrical components of the deactivation device 10. In one preferred embodiment, four coils 24, 26, 28 and 30 are housed within the housing 12 and are energized to provide alternating magnetic fields for deactivating the EAS marker. In the embodiment illustrated in FIG. 2, the coils are arranged as a first coil pair made up of coils 24 and 28 connected in series with each other, and a second coil pair made up of coils 26 and 30, also connected in series with each other. All four coils may be mounted on a single magnetic core, such as the cruciform core shown in FIG. 6 of the above-referenced '175 patent application. According to this arrangement, coils 24 and 28 are respectively disposed on co-axial arms of the magnetic core, and coils 26 and 30 are disposed on respective arms that are perpendicular to the arms on which coils 24 and 28 are disposed.

Continuing to refer to FIG. 2, reference numeral 31 indicates a source of an AC power signal to be applied to the coils. The circuitry of FIG. 2 also includes a microprocessor 32 and switches 34 and 36 which are controlled by the microprocessor 32. Switching control and interface circuitry 38 is provided to connect the microprocessor 32 with the switches 34 and 36. The switch 34 is connected between the power signal source 31 and the coil pair made up of coils 24 and 28 so that an energizing signal may be selectively supplied to the coils 24 and 28 via the switch 34. The switch 36 is connected in parallel with the switch 34 to the power signal source 31 so that the energizing signal may be selectively supplied via the switch 36 to the coils 26 and 30. A resonance capacitor 40 is connected between the switch 34 and the coils 24, 28 to form a resonant LC circuit with coils 24, 28. A resonance capacitor 42 is connected between the switch 36 and coils 26 and 30 to form a resonant LC circuit with the coils 26 and 30.

In a preferred embodiment of the invention, the power signal source 31 provides a 60 Hz signal, which may be derived from AC line power by means of one or more step-down transformers. The switches 34 and 36 may be implemented by means of power-switching transistors (such as MOSFETs or BJTs), or other suitable devices such as triacs or silicon controlled rectifiers. It should be understood that the switches 34 and 36 also include suitable supporting circuitry such as snubber networks.

The circuitry shown in FIG. 2 also includes a zero crossing detector circuit 44 which is connected to receive the alternating power signal. The zero crossing detector 44 detects zero crossing points in the power signal and provides corresponding detection signals as timing signals to the microprocessor 32. The circuitry of the deactivation device also includes (although not shown in FIG. 2) suitable DC power supplies for converting the AC input power into power levels required for operation of the microprocessor and other components aside from the coils 24, 26, 28 and 30. The above-mentioned optical sensors 16 are connected to the microprocessor 32 via an interface circuit 48 which provides conditioning for the signals output from the sensors 16, and which is described in more detail below.

Also shown in FIG. 2 is a user interface circuit 50 connected to provide input signals to the microprocessor 32. The user interface 50 allows a user to set operating parameters for the deactivation device 10. The operating parameters that are settable by the user may include (a) duty cycle of the driving signal applied to the coils, (b) peak amplitude (power level) of the driving signal applied to the coil, and/or (c) selection of motion-trigger operation versus continuous-wave operation. The user interface 50 may be a permanent part of the electronic components of the deactivation device, or may be a separate device that can be selectively connected to the microprocessor 32 through a data port (not shown).

In operation, a preferred embodiment of the deactivation device 10 is normally maintained in a dormant condition, with both switches 34 and 36 open, and no current flowing through coils 24, 28, 26 and 30, so that no deactivation field is provided, and power consumption is low. When motion is sensed through one or more of the optical sensors 16, a motion detection signal is provided to the microprocessor 32 through the sensor interface circuit 48. In response to the motion detection signal, the microprocessor 32 places the deactivation device 10 in an active condition for a predetermined limited period of time. The predetermined period of time may be on the order of 0.5 to 2.0 seconds, for example. While the deactivation device 10 is in the activated condition, it alternates between two modes of operation. In the first mode of operation, the switch 34 is closed and the switch 36 is opened, and the pair of coils 24 and 28 is energized. In the second mode of operation, switch 36 is closed and switch 34 is open, and the pair of coils 26 and 30 is energized.

Figure 3:
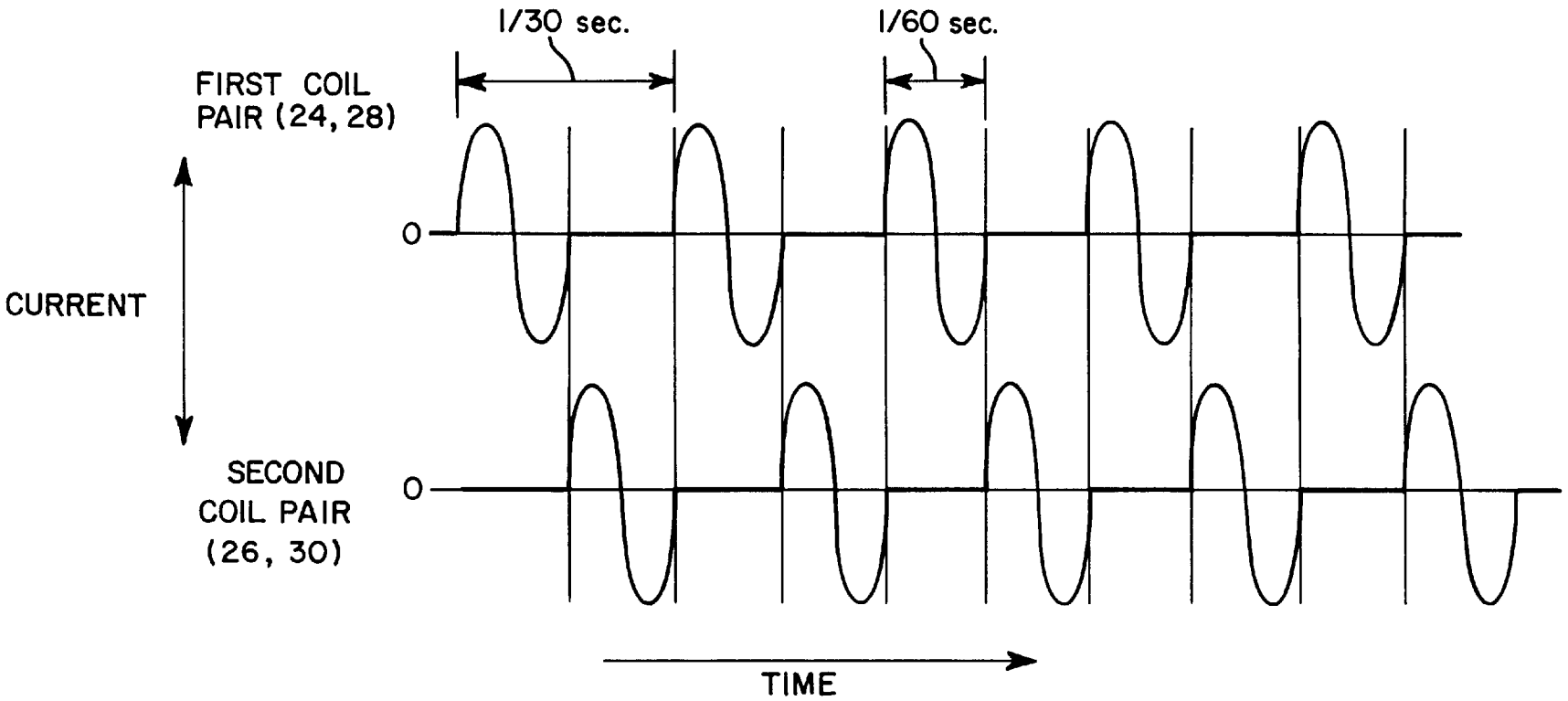
FIG. 3 is a waveform diagram which shows current levels of drive signals applied to pairs of coils shown in FIG. 2.

Operation of the deactivation device in a manner which alternates between the two operating modes is illustrated in FIG. 3. As seen from FIG. 3, each pair of coils is driven for one cycle of the power signal, then the other pair is driven for one cycle, and this sequence is repeated. It will be understood that in the resonant circuits formed by each pair of coils and its respective capacitor, capacitor current and voltage are at a 90° phase offset. FIG. 3 indicates current wave forms of the signals by which the respective pairs of coils are energized. After one pair of coils has been driven for a single cycle of the drive signal, the mode of operation is switched, and the other pair of coils is then driven for one cycle. The mode change-over is accomplished by opening the switch which corresponds to the former pair of coils and substantially simultaneously closing the switch which corresponds to the latter pair of coils. The mode change-over occurs at a timing which corresponds with the peak voltage, and the zero current point, in the cycle. Consequently, at the end of the cycle, current in the former pair of coils is at a zero point, and capacitor voltage is at a maximum. Because the switch is opened at a zero current point, the voltage in the corresponding capacitor is maintained, and there is no ring down during the period when the corresponding switch is open. It is assumed for the purposes of FIG. 3 that the input power signal is at 60 Hz, so that the period corresponding to each cycle of the drive signal is one-sixtieth of a second, and the interval at which the drive signal repeats in each of the coil pairs corresponds to 30 Hz.

Optical Sensor Interface

It is contemplated that the optical sensor interface circuit 48 may be provided in accordance with conventional practice. However, a preferred embodiment of the invention includes an improved sensor interface circuit which adapts to variations in ambient light level, blockage of a sensor, etc.

Figure 4A:
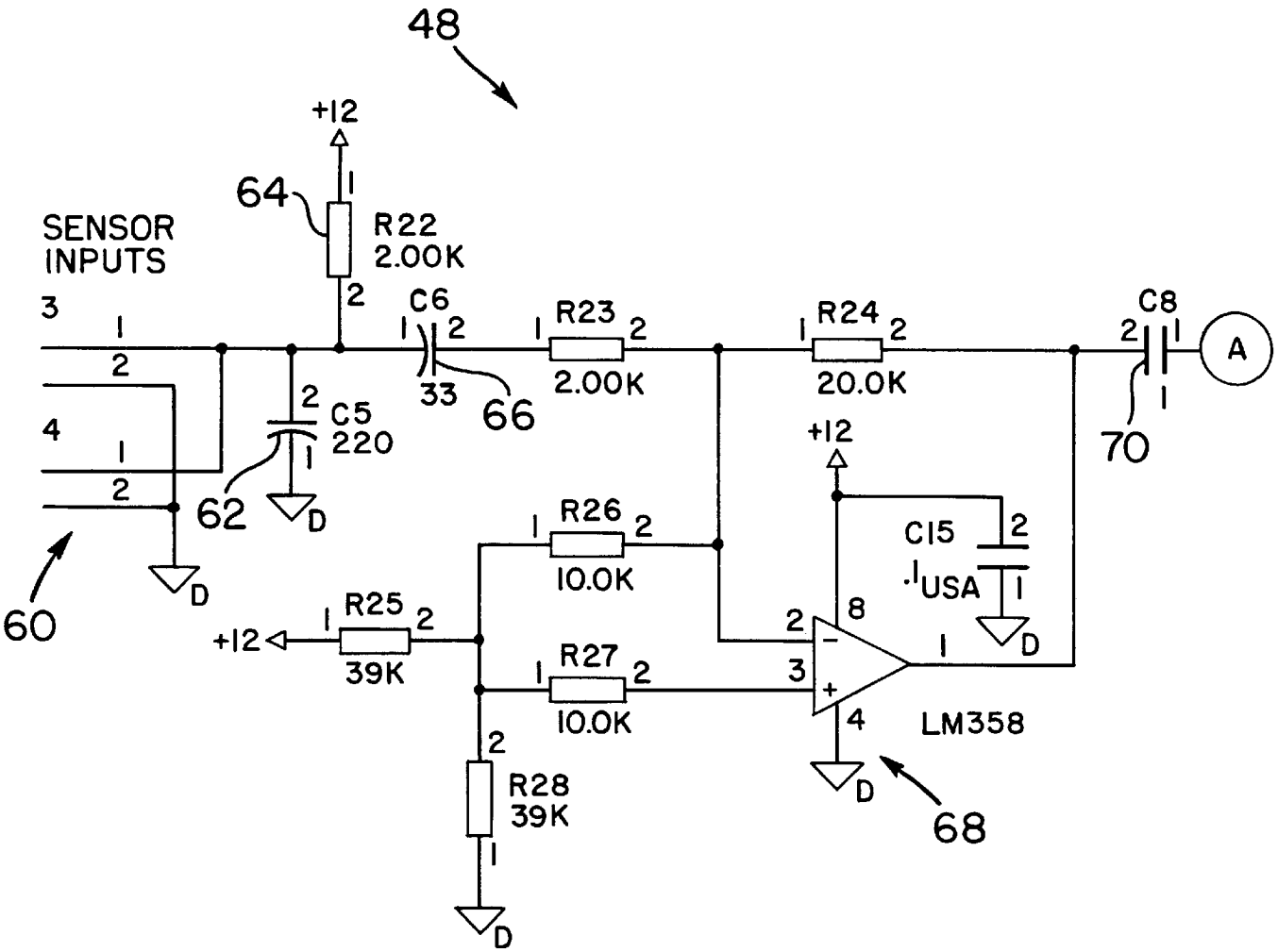
FIGS. 4A and 4B together form a schematic diagram of a sensor interface circuit block which is shown in FIG. 2.
Figure 4B:
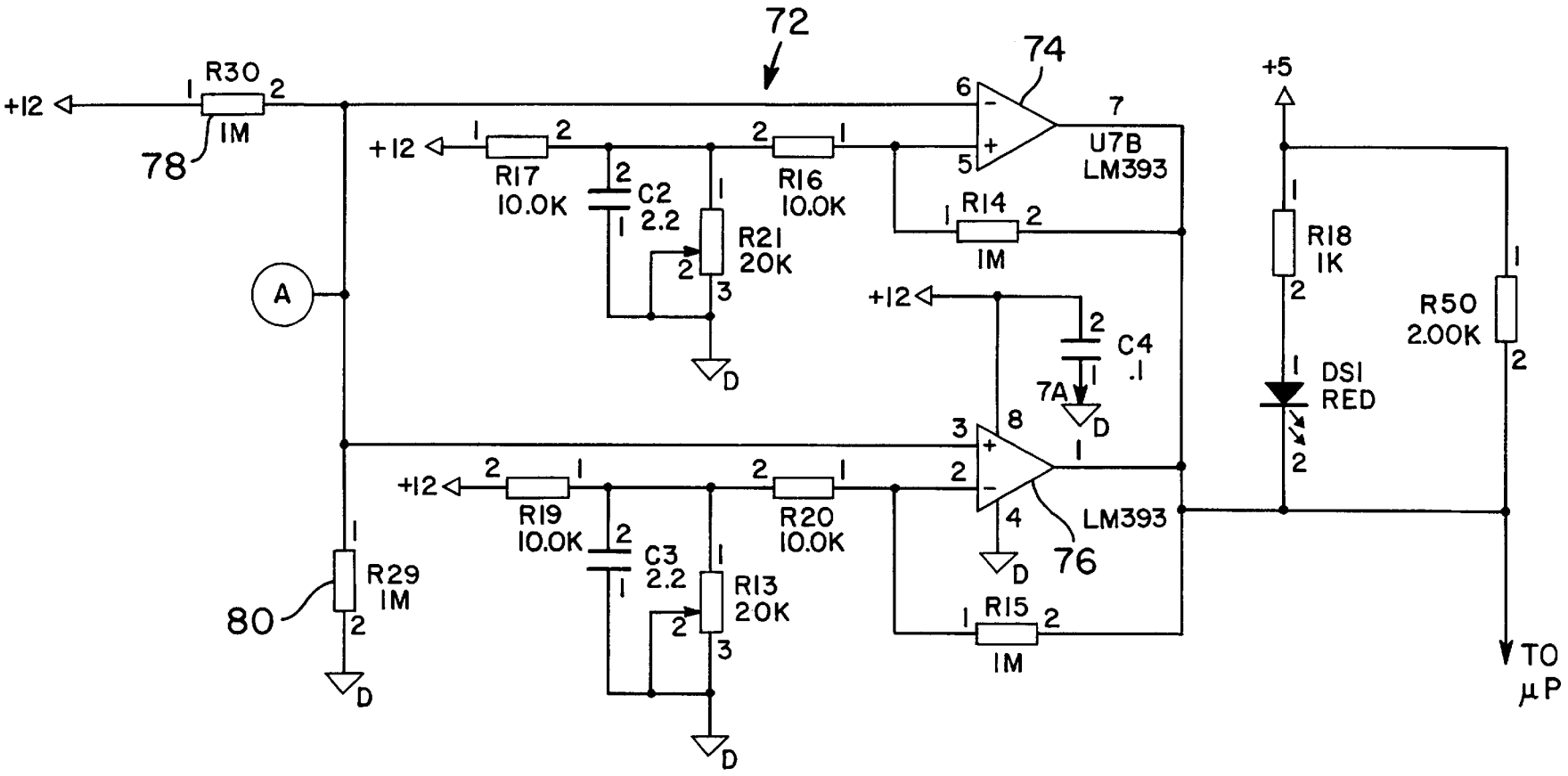

FIGS. 4A and 4B together form a schematic circuit diagram of the sensor interface circuit 48, as provided in a preferred embodiment of the invention. As indicated at 60 in FIG. 4A, the inputs from the two optical sensors 16 are connected in parallel to the interface circuit 48. Consequently, when one of the sensors is covered, its dark resistance, which is in the range of about 10–20 MΩ, does not dominate the input. The uncovered sensor, when exposed to ambient room light, has a resistance in the range of about 300–1,000 Ω, so that the uncovered sensor remains dominant. The foregoing resistance values are based on an assumption that the sensors 16 are well-known cadmium sulfide optical sensors.

A bypass capacitor 62 is provided at the inputs 60 to reduce the effect of a 60 Hz signal introduced in the input signal by the effect of fluorescent lights on the sensors 16. Also provided at the input is a DC bias level through resistor 64. A capacitor 66 is connected in series with the inputs to serve as a self-adjusting or adaptive input to an amplifier 68. The amplifier 68 is arranged to provide a gain factor of ten to permit the sensors 16 to be placed at an adequate distance from the interface circuit 48. The output of the amplifier 68 is AC coupled through a capacitor 70 to a window comparator 72. The window comparator 72 includes comparator units 74 and 76 for respectively setting up a high threshold and a low threshold, with the average level established mid-way between the rails by a DC bias determined by a voltage divider formed of resistors 78 and 80. It will be understood that the bias level established at the inputs to the comparator units has an AC signal imposed thereon from the front end of the interface circuit.

The high threshold is set at a level several millivolts greater than the average value at the input, and the lower threshold is set several millivolts lower, so as to establish a reasonable window of sensitivity to changes in light level at the sensors 16. The difference between the threshold levels establishes the distance at which a change in light level is sensed by the circuit as an article of merchandise is swept over the surface of the deactivation device. Because of the presence of the capacitor 66 at the input, the threshold window provided at the comparator 72 is adjusted for variations in the illumination level received by the sensors.

Marker Deactivation Device with Shared Capacitor

Figure 5:
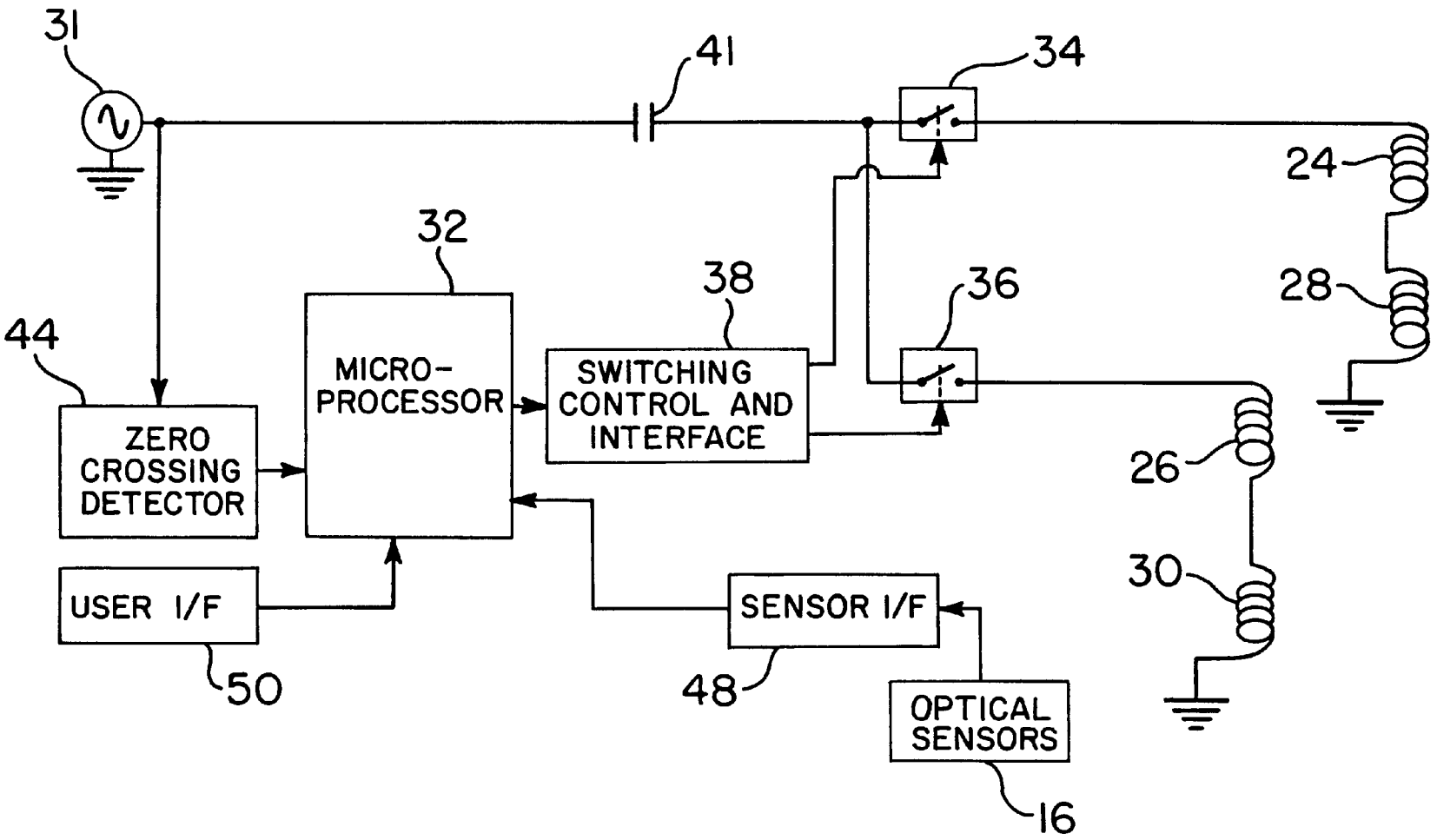
FIG. 5 is a block diagram illustration of an alternative embodiment of the circuitry of FIG. 2.

FIG. 5 illustrates a modification to the circuitry of FIG. 2, in which the capacitors 40 and 42 shown in FIG. 2 are replaced with a single capacitor 41 connected between the power source 31 and switches 34 and 36, so that the capacitor 41 is shared by both pairs of coils 24, 28 and 26, 30. When the circuit of FIG. 5 is operated in the first mode to energize coil pair 24, 28, the switch 34 is closed and the switch 36 is open, so that the capacitor 41 and coils 24, 28 form a resonant circuit. When the circuit of FIG. 5 is operated in the second mode, switch 34 is open and switch 36 is closed, so that coils 26, 30 and capacitor 41 form a resonant circuit. Preferably the switching is performed as indicated in FIG. 3, so that the capacitor 41 is driven through every cycle of the energizing signal (so long as the deactivation device is in an active condition), and switching between the modes occurs at one cycle intervals and at zero current crossing points of the power signal. As before, at the time of switching, the capacitor voltage is at a maximum.

Deactivation Field Level Adjustment

It was noted above that the user interface 50 may be used to set the level of the deactivation field provided by the deactivation device. In this way, an appropriate trade-off may be made between the range of the device (i.e., the height of the zone above the top surface 14 in which reliable deactivation occurs), versus the amount of power consumed by the deactivation device. It may also be desirable to limit the level of the deactivation field to assure that the device can be used with articles of merchandise such as prerecorded tape cassettes without causing damage to the articles.

One way in which field level setting may be accomplished is by including in the power source 31 a variable transformer (not shown) which is controllable through the microprocessor 32. Another way of reducing the amount of power consumed by the deactivation device is to reduce the duty cycle of the device. In the operational modes illustrated in FIG. 3, the deactivation device as a whole has a 100% duty cycle, and each coil pair has a 50% duty cycle. As an example, the operating modes of FIG. 3 could be modified so that the duty cycle for each coil pair was reduced to 25%, in which case the overall duty cycle of the deactivation device would be 50%. This could be done by maintaining both switches 34 and 36 in an open condition during every other cycle of the power signal.

Figure 6:
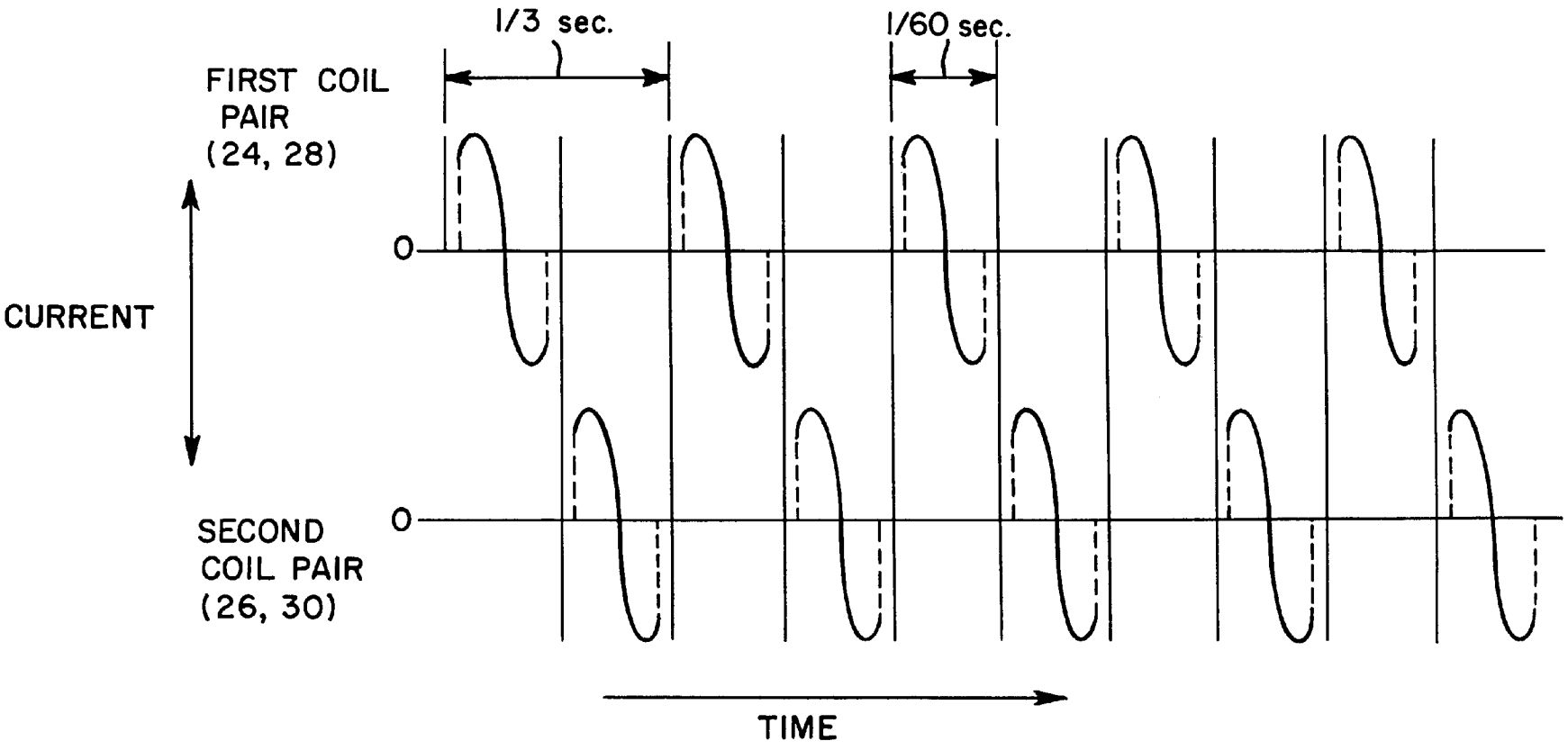
FIG. 6 is waveform diagram which shows current levels of drive signals applied to pairs of coils shown in FIG. 2, according to an alternative embodiment of the invention.

Another way of reducing the power consumption and the effective duty cycle of the deactivation device would be to curtail each cycle of the signal applied to the coil pairs, as illustrated in FIG. 6. According to this mode of operating the deactivation device, both of the switches and 34 and 36 are open during a period at the beginning and end of each cycle of the power signal. The overall power consumed, and field level provided is consequently reduced from the method of operation shown in FIG. 3. It will be recognized that each of the two operating modes in FIG. 6 no longer terminates at a zero current point in the power signal. The amount by which the drive signal cycles are truncated could be adjustable over a range of values in response to signals input via the user interface 50.

Techniques for Increasing the Frequency of the Coil Drive Signal

Referring again to FIG. 3, it will be recalled that the driving signal illustrated therein has the same frequency as the input AC power signal (assumed to be 60 Hz) and that the repetition rate for each of the two modes of operation illustrated in FIG. 3 is therefore 30 Hz. However, according to an aspect of the invention, it is desirable to increase the frequency of the coil driving signal, and the repetition rate of the two modes of operation, so that the throughput of the deactivation device can be increased by raising the speed at which a marker may be swept over the deactivation device while still assuring reliable deactivation.

Figure 7:
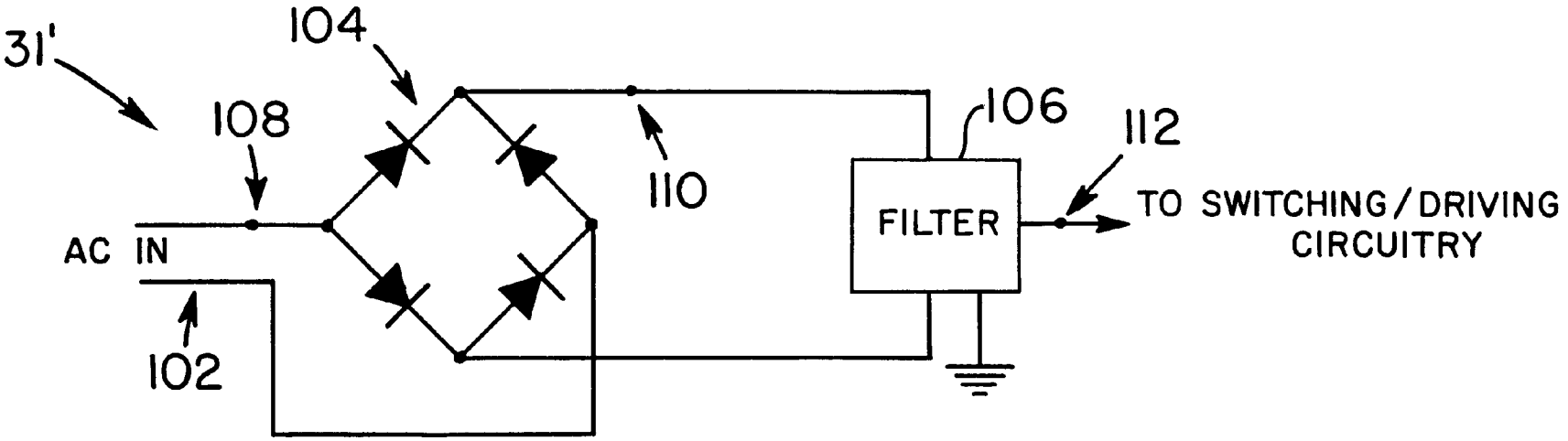
FIG. 7 schematically illustrates an AC power supply circuit that may be used in a deactivation device in accordance with the invention, the supply circuit including an arrangement to increase (double) the frequency of an input AC power signal.

FIG. 7 schematically illustrates a frequency doubling circuit 31' which may be arranged upstream from the switching and coil driving circuitry of FIG. 2 or FIG. 5 for the purpose of effectively doubling the frequency of the coil driving signal. As seen from FIG. 7, an input AC power signal, indicated at 102 (which may be a signal output from a step-down transformer) is applied to a bridge rectifier 104. The rectified signal output from the bridge rectifier 104 is provided to the switching/driving circuitry via a filter 106.

Figure 8:
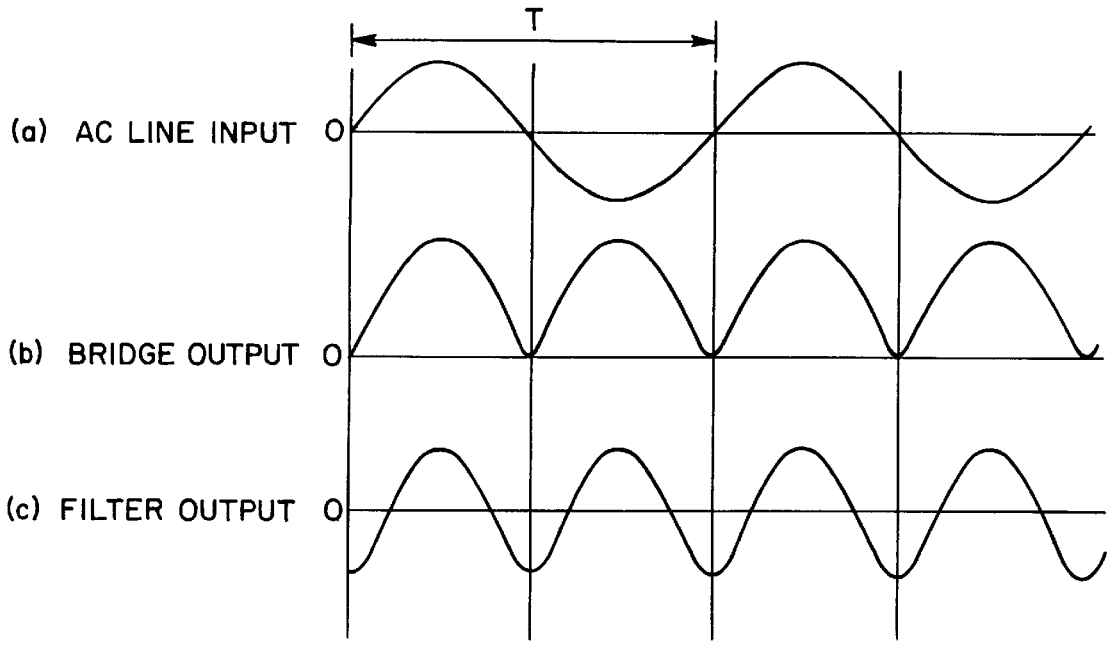
FIG. 8 shows waveforms of signals present at respective points in the circuit of FIG. 7.

FIG. 8 shows waveforms of signals present at certain points in the circuit of FIG. 7. Shown at (*a*) in FIG. 8 is the AC input signal at point 108 in FIG. 7. This signal is a sinusoid at the standard power line frequency, assumed to be 60 Hz. Consequently, the time period T shown in FIG. 8 corresponds to 1/60 second.

Indicated at (*b*) in FIG. 8 is the waveform of the rectified output from the bridge 104, present at point 110 in FIG. 7. The waveform of FIG. 8(*b*) is at a frequency f' (=½T; assumed to be 120 Hz), which is twice the frequency of the AC input signal, but the signal at point 110 has a DC offset and also includes high frequency components.

Preferably, filter 106 is arranged to block the DC component of the bridge output signal and also functions as a low pass filter with a cut-off frequency slightly above the frequency f'. Filter 106 operates to remove the DC offset from the bridge output signal while also substantially attenuating the high frequency components. (The design of filter circuit 106 is well within the capabilities of those of ordinary skilled in the art and therefore need not be described in detail.) The resulting signal output from the filter 106 is present at point 112 in FIG. 7 and it has a waveform as shown at (*c*) in FIG. 8. This signal is a sinusoid at the frequency f' and substantially without DC offset. The filter output signal is then applied in alternating modes to the coil pairs in the manner illustrated in FIG. 3, but with the repetition rate for each mode increased from 30 Hz to 60 Hz.

The insertion of the frequency doubling circuit into the EAS marker deactivation devices of FIGS. 2 and 5 promotes an increase in the throughput of the devices at a relatively low cost in terms of additional circuit elements.

Figure 9A:
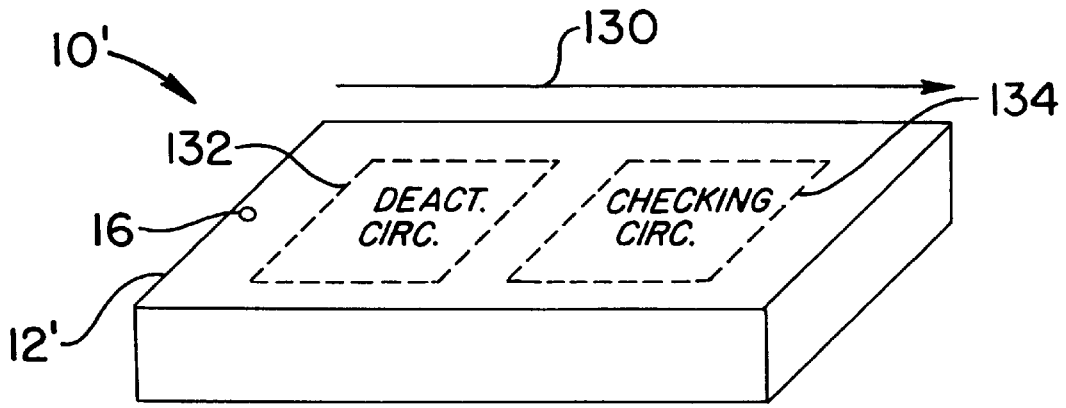
FIG. 9A is a schematic isometric view of another embodiment of the invention.
Figure 9:
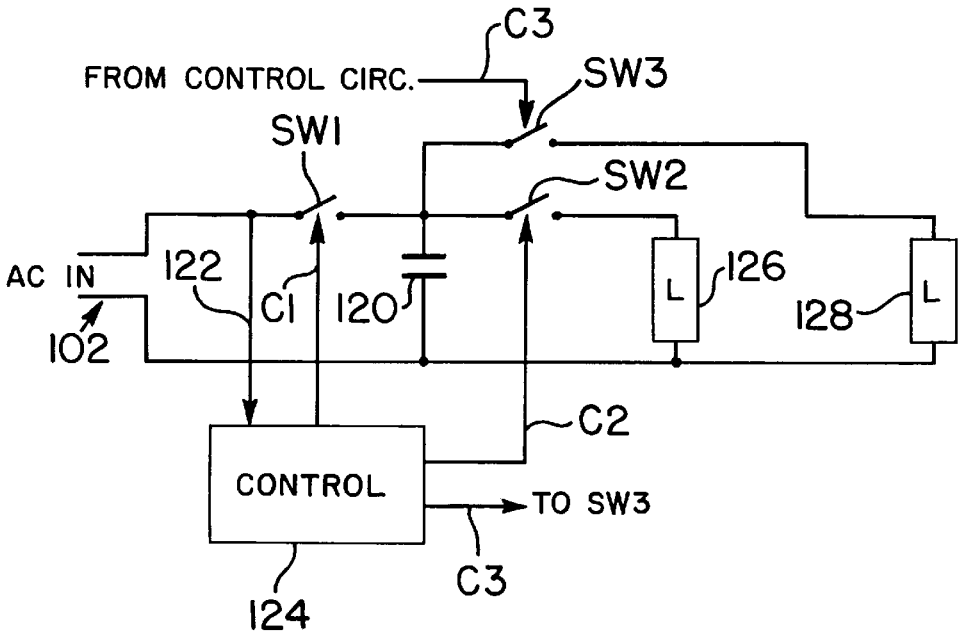
FIG. 9 shows an alternative circuit arrangement for increasing the frequency of a signal used to energize coils in a deactivation device according to the present invention.

FIG. 9 schematically illustrates another arrangement that may be employed to provide a coil driving signal at a higher frequency than the input AC power signal.

As seen from FIG. 9, the input AC power signal (indicated, as before, by reference numeral 102) is selectively connectable, via a switch SW1, to a bulk storage capacitor 120. A power sense connection, indicated at 122, permits a control circuit 124 to detect zero crossings in the AC input signal. The control circuit 124 may substantially correspond to the circuit elements indicated by the reference numerals 32, 38 and 44 in FIG. 2. The control circuit 124 generates a control signal indicated at C1 in FIG. 9 to control switch SW1. The control circuit 124 controls switch SW1 so that the AC input signal charges the storage capacitor 120 at selected times. Preferably the switch SW1 is operated so that only positive courses or only negative courses of the AC input signal are applied to the capacitor 120.

At times when the capacitor 120 stores a substantial charge, switch SW1 is opened, and either switch SW2 is closed to form a first resonant circuit which includes capacitor 120 and an inductance 126, or switch SW3 is closed to form a second resonant circuit which includes capacitor 120 and an inductance 128. The inductance 126 may correspond to a pair of coils, like the coils 24 and 28 discussed above in connection with FIG. 2 or may be a single coil, and inductance 128 may correspond to the above-described coil pair 26 and 30 or may correspond to a single coil having an orientation different from the orientation of a coil corresponding to inductance 126. For example, the core-wound coil arrangement shown in FIG. 8 of the above-referenced application Ser. No. 09/016,175 may be used.

As indicated at C2 and C3, respectively, the opening and closing of the switches SW2 and SW3 is controlled by the control circuit 124.

The values of the capacitor 120 and of the inductances 126 and 128 are selected so that the first and second resonant circuits have natural resonant frequencies that are substantially higher than the frequency of the AC input power signal. (The resonant circuits may include additional tuning elements which are not shown.) The two resonant circuits may have substantially the same resonant frequency, which in a preferred embodiment of the invention is about 300 Hz.

As in the embodiments of FIGS. 2 and 5, the embodiment of FIG. 9 is operated to switch back and forth between a first mode of operation in which the inductance 126 is driven and a second mode of operation in which the inductance 128 is driven. It is preferred that each occurrence of driving of the inductances 126 and 128 correspond to one or a few complete cycles of the oscillating driving signal, as was described above in connection with FIG. 3. Also as before, it is preferred that the switching between the two operating modes be synchronized with points in the driving signal cycle when the current flow through the respective inductance is at a zero level, and the capacitor voltage is at a maximum.

It should also be understood that triggering circuitry, which is not shown in FIG. 9, may be provided to detect the presence of a marker presented to the deactivation device and to provide an input signal to the control circuit 124 to initiate operation of the deactivation device. The trigger circuitry may operate by optical sensing, as in the above-described embodiments of FIGS. 2 and 5. Alternatively, the trigger circuitry may be constituted by conventional marker detection circuits of the type used in prior art marker deactivation devices. As known to those who are skilled in the art, the conventional marker detection component used in prior deactivation devices includes an interrogation element and a detection element. The interrogation element generates an interrogation signal at regular brief intervals to stimulate a response from a marker presented to the deactivation device. The detection element detects the responses from a marker so presented, and then triggers operation of the deactivation device to deactivate the marker.

After triggering, the deactivation device illustrated in FIG. 9 operates for a period of time to alternately energize the inductances 126 and 128. After a period of operation in response to the triggering, both switches SW2 and SW3 are maintained in an open condition, and switch SW1 is closed at appropriate times to increase the charge stored on capacitor 120.

It will be understood that the inductances 126 and 128 are somewhat resistive, leading to power loss when the inductances are energized. Additional losses can be expected to occur in the conductors which connect the circuit elements. Also, if the inductances include coils wound around a magnetic core, as in a preferred embodiment of the invention, then core losses will also occur. To minimize the amount of energy dissipated during operation of the deactivation device, it is desirable to design the resonant circuits to have a high Q.

Although the arrangement of FIG. 9 shows a single storage capacitor shared by both resonant circuits by a time-division multiplexing scheme, it is contemplated to modify the arrangement so as to provide a separate storage capacitor for each one of the resonant circuits.

The driving circuit shown in FIG. 9 substantially increases the frequency of the coil driving signal, which makes it possible to substantially increase the repetition rate of the alternate operating modes. This, in turn, increases the potential throughput of the deactivation device, since the speed at which a marker can be swept over the device can be increased while still achieving reliable deactivation. In addition, or alternatively, it is possible to reduce the space in which the deactivation signal field is radiated, so that the "footprint" of the deactivation device can be reduced. This helps to conserve space at the checkout counter.

A particularly preferred embodiment of a marker deactivation device according to the invention includes, in combination, a conventional marker detection circuit to function as a trigger device, two coils wound in orthogonally different directions on a square or rectangular flat magnetic core (as in the arrangement shown in FIG. 8 of the above-referenced '175 patent application), and a modified version of the frequency boost circuit of FIG. 9 of the present application, including a respective resonant circuit for driving each of core-wound coils, and with a separate storage capacitor for each of the resonant circuits. In this preferred embodiment, each resonant circuit has a natural resonant frequency of about 300 Hz. The deactivation device is switched back and forth between respective modes in which each of the core-wound coils is energized. Each occurrence of one of the operating modes consists of one or a few complete cycles of the coil driving signal.

With the high mode repetition rate that is possible in this embodiment, the magnetic core may be made rather small in size, so that the deactivation device as a whole has a small footprint that makes it especially attractive for installation at a retail store checkout counter.

In addition to high throughput, the embodiment shown in FIG. 9 also provides for energy efficiency, because the switching at the zero-current points results in the energy of the oscillation signal alternately applied to the coils 126 and 128 being stored in the capacitor, except for energy dissipation which takes place as the coils are driven. As noted before, it is desirable to select the capacitor 120 and coils 126 and 128 to provide for high Q to minimize energy dissipation.

The energy-storing feature of switching away from coil driving at a zero-current point in the coil-energizing signal also may be applied when only one field generating coil is to be included in the deactivation device. In other words, the embodiment of FIG. 9 may be modified by omitting coil 128 and switch SW3.

It is also contemplated that the AC signal provided by the power source 102 could be converted to DC and possibly also stored in a battery before being used to charge the capacitor 120.

Moreover, circuitry may be provided between the AC source 102 and the capacitor 120 for the purpose of increasing the peak voltage to which the capacitor is charged. For example, a step-up transformer may be used.

Noting that the coils 126, 128 also constitute energy storage devices, it is to be appreciated that the circuit of FIG. 9 can be rearranged to take advantage of the energy storing capability of at least one of the coils. That is, the positions of the capacitor 120 and coil 126 (or equivalently, coil 128), as shown in FIG. 9, may be interchanged. In that case, coil 126 may be charged through switch SW1, then switch SW2 closed, just before opening switch SW1, to establish a resonant circuit formed of coil 126 and capacitor 120. From that point forward, the capacitor is switched between coils 126 and 128 at zero current points, until further charging from the AC source is required.

Marker Deactivation Device Incorporating Optical Triggering and Deactivation Checking FIG. 9A schematically illustrates an alternative embodiment of the invention. In FIG. 9A, reference numeral 10' generally indicates a modified version of the deactivation device of FIG. 1. The deactivation device 10' is adapted to deactivate a marker swept over the device from left to right along the path indicated by arrow 130. The deactivation device 10' includes a housing 12'. At a left-ward edge of the housing 12', an optical sensor 16 is mounted. To the right of the optical sensor 16 a deactivation circuit 132 is installed within the housing 12'. The deactivation circuit 132 may be like any one of the circuits illustrated in FIGS. 2, 5 and 9.

A checking circuit 134 is provided in the housing 12' to the right of the deactivation circuit 132. The purpose of the checking circuit 134 is to confirm that deactivation of the marker has in fact occurred. The checking circuit 134 may be like circuits provided for the same purpose in prior art deactivation devices.

Not shown in FIG. 9A are signal paths to connect the optical sensor 16 to the deactivation circuit 132 and the checking circuit 134.

It is noted that the optical sensing proposed in connection with the embodiments of FIGS. 1 and 9A provides certain advantages as compared to conventional marker detection circuits used to trigger prior art deactivation devices. Unlike the conventional detection circuits, the optical sensor 16 will operate even if the marker presented for deactivation deviates from the nominal marker signal frequency. Thus, the optical sensor will trigger the deactivation device to operate in cases where the conventional detection circuit would fail to trigger the deactivation device. Moreover, the optical sensor operates more quickly than the conventional detection circuit so that throughput is increased and there is less chance of failing to trigger the deactivation device in time for reliable operation.

Preferred modes of operating the deactivation device call for switching between one mode (in which a first coil pair is driven) to another mode (in which the second coil pair is driven) at intervals corresponding to one cycle of the drive signal. However, it is also contemplated to drive each coil pair continuously over intervals which correspond to two, three or other rather small integral multiples of the drive signal cycle.

Although the user interface 50 is included in a preferred embodiment of the invention, the user interface is not essential to the invention and may be omitted.

It is also contemplated to omit the optical sensors 16 so that the deactivation device operates entirely in a continuous wave mode, or to provide triggering for intermittent operation by other means, such as a user-actuated triggering circuit, or by providing circuitry for interrogating and automatically detecting the presence of a marker as in certain conventional deactivation devices. It is further contemplated to use only one optical sensor, or three, four or more optical sensors. If four sensors are used, for example, a sensor could be installed adjacent to a central point on each of the four edges of the top surface 14 of the device housing 12 (FIG. 1).

Four coils are shown in the preferred embodiment illustrated herein, but it is contemplated to reduce the total number of coils to two or three, or to increase the number of coils, it being understood that the invention is concerned with driving at least one coil only during one mode of operation, driving at least one other coil only during another mode of operation, and rapidly switching between the two modes of operation.

Various other changes in the foregoing apparatus and practices may be introduced without departing from the invention. The particularly preferred embodiments of the invention are thus intended in an illustrative and not limiting sense. The true spirit and scope of the invention are set forth in the following claims.

What is claimed is:

1. Apparatus for deactivating a magnetomechanical EAS marker, comprising:

a first coil;

a second coil; and means for energizing said first and second coils with an alternating drive signal to generate respective alternating magnetic fields for deactivating the marker, said means for energizing including means for switching the apparatus between a first mode of operation in which said first coil is energized and said second coil is not energized and a second mode of operation in which said second coil is energized and said first coil is not energized;

wherein said means for switching operates to switch the apparatus between said modes of operation at times corresponding to zero-crossing points of said alternating magnetic fields.

2. An apparatus according to claim 1, wherein said apparatus is operated in said first mode in a first sequence of time intervals and is operated in said second mode in a second sequence of time intervals interleaved with said first sequence of time intervals.

3. An apparatus according to claim 2, wherein each of said time intervals of said first and second sequences is substantially equal in duration to one cycle of said alternating drive signal.

4. An apparatus according to claim 2, wherein all of said time intervals of said first and second sequences are substantially equal in duration, and each of said time intervals has a duration that is no shorter than a period corresponding to two cycles of said alternating drive signal.

5. An apparatus according to claim 1, further comprising a first capacitor connected in series with said first coil and a second capacitor connected in series with said second coil.

6. An apparatus according to claim 5, wherein said first capacitor is maintained in a charged condition during said second mode of operation, and said second capacitor is maintained in a charged condition during said first mode of operation.

7. An apparatus according to claim 1, further comprising a capacitor selectively connected through said means for switching to said first coil and said second coil.

8. An apparatus according to claim 1, further comprising:

a third coil energized by said means for energizing only during said first mode of operation; and a fourth coil energized by said means for energizing only during said second mode of operation.

9. Apparatus for deactivating a magnetomechanical EAS marker, comprising:

a first coil;

a second coil; and means for energizing said first and second coils with an alternating drive signal to generate respective alternating magnetic fields for deactivating the marker, said means for energizing including means for switching the apparatus between a first mode of operation in which said first coil is energized and said second coil is not energized and a second mode of operation in which said second coil is energized and said first coil is not energized;

said apparatus operating in said first mode in a first sequence of time intervals and operating in said second mode in a second sequence of time intervals interleaved with said first sequence of time intervals;

each of said time intervals of said first and second sequences having a duration that is no longer than one cycle of said alternating drive signal.

10. An apparatus according to claim 9, further comprising a first capacitor connected in series with said first coil and a second capacitor connected in series with said second coil.

11. An apparatus according to claim 10, wherein said first capacitor is maintained in a charged condition during said second mode of operation, and said second capacitor is maintained in a charged condition during said first mode of operation.

12. An apparatus according to claim 9, further comprising a capacitor selectively connected through said means for switching to said first coil and said second coil.

13. An apparatus according to claim 9, further comprising:

a third coil energized by said means for energizing only during said first mode of operation; and a fourth coil energized by said means for energizing only during said second mode of operation.

14. An apparatus according to claim 9, further comprising:

control means for controlling said means for energizing; and user input means for permitting a user to input a control signal to said control means;

said control means controlling said means for energizing so as to adjust the durations of said time intervals in accordance with said control signal input by said user.

15. An apparatus according to claim 9, wherein each of said time intervals is shorter than one cycle of said alternating drive signal.

16. Apparatus for deactivating a magnetomechanical EAS marker, comprising:

at least one coil;

a trigger circuit including: at least one optical sensor; means for comparing with a threshold a signal level output by said at least one optical sensor; and means for adjusting said threshold in accordance with fluctuations in said signal level output by said at least one optical sensor; and means responsive to said trigger circuit for selectively energizing said at least one coil.

17. Apparatus according to claim 16, wherein said means for adjusting includes a capacitor connected in series with said at least one optical sensor.

18. Apparatus according to claim 17, wherein said at least one optical sensor includes two optical sensors connected, in parallel with each other, to said capacitor.

19. Apparatus according to claim 18, wherein said optical sensors are cadmium-sulfide sensors.

20. Apparatus according to claim 17, further comprising checking means for determining whether the magnetomechanical EAS marker was deactivated by exposure to an alternating magnetic field generated by the energized at least one coil.

21. Apparatus for deactivating a magnetomechanical EAS marker, comprising:

a first coil;

a first capacitor connected in series with said first coil;

means for energizing said first coil with an alternating drive signal to generate an alternating magnetic field for deactivating the marker, said means for energizing including means for switching the apparatus between a first mode of operation in which said first coil is energized and a second mode of operation in which said first coil is not energized;

said means for energizing operating so that said capacitor is maintained in a charged condition in said second mode of operation.

22. An apparatus according to claim 21, further comprising a second coil and a second capacitor connected in series with said second coil;

said means for energizing operating to energize said second coil in said second mode of operation, and to maintain said second capacitor in a charged condition in said first mode of operation.

23. Apparatus for deactivating a magnetomechanical EAS marker, comprising:

a first resonant circuit for generating a first alternating magnetic field during a first sequence of time intervals;

a second resonant circuit for generating a second alternating magnetic field during a second sequence of time intervals interleaved with said first sequence of time intervals; and means, switchably connected to said first and second resonant circuits, for energizing said first and second resonant circuits during said first and second sequences, respectively;

said alternating magnetic fields for degaussing a bias element of said magnetomechanical EAS marker.

24. Apparatus according to claim 23, wherein:

said first resonant circuit includes a first coil and a first capacitor connected in series with said first coil; and said second resonant circuit includes a second coil and a second capacitor connected in series with said second coil.

25. Apparatus according to claim 23, further comprising a housing in which said first and second resonant circuits are contained, said housing having a substantially flat top surface at which said EAS marker is presented for deactivation.

26. Apparatus for deactivating a magnetomechanical EAS marker, comprising:

source means for providing an alternating drive signal;

a capacitor connected in series with said source means;

a first coil;

a second coil; and switch means for switching said capacitor between a series connection with said first coil and a series connection with said second coil;

said first and second coils each for generating a respective alternating magnetic field for degaussing a bias element of said magnetomechanical marker.

27. Apparatus according to claim 25, further comprising a housing in which said first and second coils are contained, said housing having a substantially flat top surface at which said EAS marker is presented for deactivation.

28. A method of deactivating a magnetomechanical EAS marker, comprising the steps of:

providing a first coil and a second coil;

applying an alternating drive signal to said first coil during a first mode of operation to generate a first alternating magnetic field;

applying said alternating drive signal to said second coil during a second mode of operation to generate a second alternating magnetic field;

switching between said first and second modes of operation at times corresponding to zero-crossing points of said first and second alternating magnetic fields; and sweeping the EAS marker through said first and second alternating magnetic fields to degauss a bias element of the EAS marker.

29. A method of deactivating a magnetomechanical EAS marker, comprising the steps of:

(a) providing a first coil and a second coil;

(b) applying one cycle of an alternating drive signal to said first coil;

(c) immediately after completion of step (b), applying one cycle of the alternating drive signal to said second coil;

(d) immediately after completion of step (c), applying one cycle of the alternating drive signal to said first coil; and (e) sweeping the EAS marker in proximity to said first and second coils during steps (b)–(d) to degauss a bias element of the EAS marker.

30. Apparatus for deactivating a magnetomechanical EAS marker, comprising:

at least one coil;

means for providing an AC power signal at a first frequency; and means for receiving the AC power signal and for converting the received power signal to a second frequency that is higher than the first frequency;

said at least one coil being energized by the converted power signal at the second frequency.

31. Apparatus according to claim 30, wherein the second frequency is twice the first frequency.

32. Apparatus according to claim 30, wherein said means for receiving and converting the AC power signal includes a bridge rectifier for rectifying the AC power signal and a filter for filtering the rectified signal output from the bridge rectifier.

33. Apparatus according to claim 30, wherein said means for receiving and converting the AC power signal includes:

a storage capacitor, selectively connectable to receive the AC power signal, for being charged by the AC power signal; and oscillation means, selectively connectable to said storage capacitor and including said at least one coil, for oscillating at the second frequency.

34. Apparatus according to claim 30, wherein said at least one coil includes a first coil energized during a first mode of operation of the apparatus, and a second coil energized during a second mode of operation of the apparatus, said first coil not being energized during said second mode of operation and said second coil not being energized during said first mode of operation.

35. Apparatus according to claim 34, further comprising a third coil energized only during said first mode of operation and a fourth coil energized only during said second mode of operation.

36. Apparatus according to claim 30, wherein:

said at least one coil includes a first coil and a second coil; and said means for receiving and converting the AC power signal includes:

a first storage capacitor, selectively connectable to receive the AC power signal, for being charged by the AC power signal, and selectively connectable to said first coil to form a first resonant circuit that oscillates at said second frequency; and a second storage capacitor, selectively connectable to receive the AC power signal, for being charged by the AC power signal, and selectively connectable to said second coil to form a second resonant circuit.

37. Apparatus according to claim 36, wherein said second resonant circuit oscillates at said second frequency.

38. Apparatus according to claim 37, further comprising a magnetic core around which said first and second coils are wound.

39. Apparatus for deactivating a magnetomechanical EAS marker, comprising:

a storage capacitor;

charging means for selectively charging said storage capacitor;

a coil for generating a magnetic field for deactivating said EAS marker; and switching means for selectively connecting said storage capacitor to said coil, at times when said storage capacitor is in a charged condition, to form a resonant circuit which includes said storage capacitor and said coil, said resonant circuit having an oscillation signal therein at times when said coil is connected to said charged storage capacitor to form said resonant circuit, said switching means being operated to disconnect said coil from said storage capacitor only at a timing which corresponds to a zero current point of said oscillation signal.

40. Apparatus according to claim 39, wherein said switching means is operated so that said coil is connected to said storage capacitor to form said resonant circuit for a period of time which does not exceed the duration of one cycle of said oscillation signal.

41. Apparatus according to claim 39, wherein said charging means includes a source of an AC power signal and means for selectively applying said AC power signal to said storage capacitor.

42. Apparatus according to claim 41, wherein said AC power signal has a first frequency and said oscillation signal has a second frequency higher than said first frequency.

43. Apparatus according to claim 42, wherein said first frequency is 60 Hz.

44. Apparatus according to claim 39, further comprising a housing in which said coil is contained, said housing having a substantially flat top surface at which said EAS marker is presented for deactivation.

45. A method of operating a device for deactivating a magnetomechanical EAS marker, the method comprising the step of:

(a) connecting an AC line power source to a storage capacitor to charge said storage capacitor;

(b) disconnecting said AC line power source from said charged storage capacitor;

(c) at a time when said charged storage capacitor is not connected to said AC line power source, connecting said charged storage capacitor to a coil to form a resonant circuit which includes said storage capacitor and said coil;

(d) simultaneously with step (c), sweeping said magnetomechanical EAS marker in proximity to said coil; and (e) disconnecting said coil from said storage capacitor.

46. A method according to claim 45, wherein said step (e) is performed at a timing which corresponds to a zero current point of an oscillation signal present in said resonant circuit during said step (c).

* * * * *

UNITED STATES PATENT AND TRADEMARK OFFICE

CERTIFICATE OF CORRECTION

PATENT NO. : 6,111,507
DATED : August 29, 2000
INVENTOR(S) : Jorge Fernando Alicot, et al.

It is certified that error appears in the above-identified patent and that said Letters Patent is hereby corrected as shown below:

Column 13,
Line 61, delete "claim 17" and insert -- claim 16 --.

Signed and Sealed this

Sixth Day of November, 2001

*Attest:*

Nicholas P. Godici

*Attesting Officer*

NICHOLAS P. GODICI
*Acting Director of the United States Patent and Trademark Office*